US010876285B1

(12) United States Patent
Wigboldy et al.

(10) Patent No.: US 10,876,285 B1
(45) Date of Patent: Dec. 29, 2020

(54) MASONRY VENEER WALL TIE APPARATUS AND METHOD FOR BUILDING CONSTRUCTION

(71) Applicant: Rodenhouse, Inc., Grand Rapids, MI (US)

(72) Inventors: Jason R. Wigboldy, Grand Rapids, MI (US); Robert H. Rodenhouse, Grand Rapids, MI (US)

(73) Assignee: Rodenhouse, Inc., Grand Rapids, MI (US)

( * ) Notice: Subject to any disclaimer, the term of this patent is extended or adjusted under 35 U.S.C. 154(b) by 0 days.

(21) Appl. No.: 16/233,978

(22) Filed: Dec. 27, 2018

Related U.S. Application Data

(63) Continuation of application No. 15/630,593, filed on Jun. 22, 2017, now abandoned.

(60) Provisional application No. 62/353,084, filed on Jun. 22, 2016.

(51) Int. Cl.
*E04B 1/41* (2006.01)
*E04F 13/08* (2006.01)

(52) U.S. Cl.
CPC ..... *E04B 1/4178* (2013.01); *E04F 13/0832* (2013.01)

(58) Field of Classification Search
CPC ..... E04B 1/4178; E04F 13/0832
USPC ..... 52/713
See application file for complete search history.

(56) References Cited

U.S. PATENT DOCUMENTS

D32,793 S 6/1900 Fauber
2,174,844 A * 10/1939 Sedore ..... E04B 1/4178 52/713
2,262,130 A * 11/1941 Bagley ..... E04B 1/4178 52/714

(Continued)

FOREIGN PATENT DOCUMENTS

CA 1251336 A * 3/1989 ..... E04B 1/4178
CA 2234485 A1 10/1999

(Continued)

OTHER PUBLICATIONS

Brochure disclosing 2" diameter Plasti-Grip® PBLP2 washer distributed by Rodenhouse Inc. more than one year prior to Sep. 6, 2012.

(Continued)

*Primary Examiner* — Jeanette E Chapman
(74) *Attorney, Agent, or Firm* — Gardner, Linn, Burkhart & Ondersma LLP

(57) ABSTRACT

A wall tie assembly is provided for use in building construction for connecting a masonry veneer, such as brick or stone, to a building wall while inhibiting compression of building insulation disposed between an internal wall and the veneer. The wall tie assembly includes a washer through which a fastener is disposed and couples to a tie member. The fastener fixes to the structural portion of the wall through the insulation, such that the washer may interface with the exterior surface of the insulation in a manner to form a seal that prevents moisture and air from penetrating through the aperture formed in a weather barrier of the internal wall by the fastener. The tie member attaches between the head of the fastener and the washer and is bent for positioning within mortar of the masonry veneer of the wall.

15 Claims, 7 Drawing Sheets

(56) References Cited

U.S. PATENT DOCUMENTS

| | | | | |
|---|---|---|---|---|
| 2,588,631 | A * | 3/1952 | James | E04G 15/063 52/713 |
| 2,742,778 | A * | 4/1956 | Olmstead | E04F 13/06 52/713 |
| 3,069,919 | A | 12/1962 | Schultz, Jr. | |
| 4,102,239 | A | 7/1978 | Dallas | |
| 4,114,597 | A | 9/1978 | Erb | |
| 4,292,876 | A | 10/1981 | De Graan | |
| 4,793,757 | A | 12/1988 | Peterson | |
| 4,959,938 | A | 10/1990 | De Caro | |
| 5,079,055 | A | 1/1992 | Doyle | |
| 5,419,666 | A | 5/1995 | Best | |
| 5,423,858 | A | 6/1995 | Bolanos et al. | |
| 5,456,052 | A * | 10/1995 | Anderson | E04B 1/4185 52/379 |
| 5,517,883 | A | 5/1996 | Goldi et al. | |
| 5,541,377 | A | 7/1996 | Stuhlmacher | |
| 5,803,693 | A | 9/1998 | Choiniere et al. | |
| 5,833,422 | A | 11/1998 | Haga et al. | |
| D410,869 | S | 6/1999 | Singer | |
| 6,039,525 | A | 3/2000 | Johnson | |
| 6,212,841 | B1 | 4/2001 | Plume | |
| 6,231,063 | B1 | 5/2001 | Chi | |
| D482,270 | S | 11/2003 | Derilo | |
| 6,665,991 | B2 | 12/2003 | Hasan | |
| D517,404 | S | 3/2006 | Schluter | |
| 7,090,455 | B2 | 8/2006 | Lamb | |
| D549,091 | S | 8/2007 | McIntyre et al. | |
| 7,415,803 | B2 | 8/2008 | Bronner | |
| D576,480 | S | 9/2008 | Vakiener et al. | |
| D596,934 | S | 7/2009 | Vakiener et al. | |
| D634,248 | S | 3/2011 | Chen | |
| 7,896,380 | B2 | 3/2011 | Tange | |
| D644,921 | S | 9/2011 | Hsu et al. | |
| D645,337 | S | 9/2011 | Hsu et al. | |
| D660,691 | S | 5/2012 | Yamazaki | |
| D663,243 | S | 7/2012 | Li | |
| 8,336,275 | B2 | 12/2012 | Rodenhouse | |
| D679,169 | S | 4/2013 | Else | |
| D679,572 | S | 4/2013 | Attaway | |
| 8,413,740 | B2 | 4/2013 | Rodenhouse | |
| D682,666 | S | 5/2013 | Wigboldy | |
| D696,930 | S | 1/2014 | Rodenhouse et al. | |
| D696,931 | S | 1/2014 | Rodenhouse et al. | |
| D696,932 | S | 1/2014 | Rodenhouse et al. | |
| 8,904,731 | B2 * | 12/2014 | Hohmann, Jr. | E04B 1/4178 52/714 |
| D744,799 | S | 12/2015 | Rodenhouse et al. | |
| D748,973 | S | 2/2016 | Rodenhouse et al. | |
| D749,941 | S | 2/2016 | Rodenhouse et al. | |
| 9,309,915 | B1 * | 4/2016 | Rodenhouse | B25C 7/00 |
| D755,622 | S | 5/2016 | Rodenhouse et al. | |
| 9,353,515 | B2 | 5/2016 | Farahmandpour | |
| 9,631,667 | B2 | 4/2017 | Rodenhouse et al. | |
| D795,685 | S | 8/2017 | Rodenhouse et al. | |
| 9,890,807 | B1 | 2/2018 | Rodenhouse et al. | |
| 9,945,414 | B1 | 4/2018 | Rodenhouse et al. | |
| 9,989,082 | B2 | 6/2018 | Rodenhouse et al. | |
| 2004/0060723 | A1 | 4/2004 | Pallapothu | |
| 2004/0084099 | A1 | 5/2004 | Miura | |
| 2006/0171794 | A1 | 8/2006 | Ordonio, Jr. et al. | |
| 2007/0011964 | A1 | 1/2007 | Smith | |
| 2008/0115439 | A1 * | 5/2008 | Tamlyn | E04B 1/4178 52/379 |
| 2008/0310932 | A1 | 12/2008 | McIntyre et al. | |
| 2010/0019014 | A1 | 1/2010 | Rodenhouse | |

FOREIGN PATENT DOCUMENTS

| | | | | |
|---|---|---|---|---|
| DE | 102007026733 | A1 | 12/2008 | |
| EP | 1510629 | A1 | 2/2005 | |
| GB | 2115854 | A * | 9/1983 | E04F 13/0857 |
| GB | 2134943 | A * | 8/1984 | E04B 1/4178 |
| GB | 2147023 | A * | 5/1985 | E04B 1/4178 |
| GB | 2153892 | A * | 8/1985 | E04B 1/4178 |
| GB | 2393978 | A * | 4/2004 | E04B 1/4178 |
| NL | 1011079 | C1 * | 10/1999 | E04B 1/4185 |
| WO | 2006114177 | A1 | 11/2006 | |

OTHER PUBLICATIONS

Brochure disclosing 1-3/4" diameter Plasti-Grip® CBW washer distributed by Rodenhouse Inc. more than one year prior to Sep. 6, 2012.

Brochure disclosing 1-1/4" diameter Grip-Plate® Tab washer distributed by Rodenhouse Inc. more than one year prior to Sep. 6, 2012.

Brochure disclosing 1-1/4" diameter Grip-Plate® Plastic washer distributed by Rodenhouse Inc. more than one year prior to Sep. 6, 2012.

Brochure disclosing 2" diameter Plasti-Grip® CBW2 washer distributed by Rodenhouse Inc. more than one year prior to Sep. 6, 2012.

Brochure disclosing 1-3/4" diameter Plasti-Grip® III washer distributed by Rodenhouse Inc. more than one year prior to Sep. 6, 2012.

Brochure disclosing Plasti-Grip® PMF Plastic Masonry Fastener distributed by Rodenhouse Inc. more than one year prior to Sep. 6, 2012.

Brochure disclosing 3" diameter Grip-Lok® "Hurricane" washer distributed by Rodenhouse Inc. more than one year prior to Sep. 6, 2012.

Grid-Mate PB Mechanical Fasteners, 1999 Tool Works, Inc.

Wind-Lock catalog excerpt disclosing fastening tool system available prior to Jul. 23, 2007.

Wind-Lock catalog excerpt, disclosing fastening tool equipment available prior to Jul. 23, 2007.

Wind-Lock catalog excerpt dated 2001.

Wind-Lock catalog excerpt dated 2003.

STUCCOFAST brochure disclosing fastening system available prior to Jul. 23, 2007.

Performance and Selector Guide 2002, 2001 Illinois Tool Works Inc.

Web pages from ITW Commercial Construction (www.itwramset.com) showing magnetic adapter Part No. 2761910 for metal washers believed to be available more than one year prior to Mar. 15, 2013.

* cited by examiner

MASONRY VENEER WALL TIE APPARATUS AND METHOD FOR BUILDING CONSTRUCTION

CROSS REFERENCE TO RELATED APPLICATION

The present application is a continuation of U.S. application Ser. No. 15/630,593, filed Jun. 22, 2017, which claims priority of U.S. provisional application, Ser. No. 62/353,084 filed Jun. 22, 2016, which are both hereby incorporated herein by reference in their entireties

BACKGROUND AND FIELD OF THE INVENTION

The present invention is directed to a wall tie apparatus and system, and in particular to a wall tie for building construction with masonry veneers, such as bricks or rocks.

Masonry veneers, such as brick or rock walls, including natural or artificial rock, are used for exterior wall purposes in building construction. Such masonry veneers must be anchored to internal walls or sub-systems.

SUMMARY OF THE INVENTION

The wall tie assembly in accordance with the present invention for use in building construction fixes a veneer, such as brick or stone, to a building wall while inhibiting compressing building insulation. The wall tie assembly includes a washer through which a fastener is disposed and couples to a tie member, such as a strap or wire. The fastener fixes the washer to the building wall through the insulation. The tie member is configured to quickly attach to the wall at a manufacturing facility in a configuration against the wall or at the building construction site. Once attached to the wall, the tie member may be moved, such as via bending or pivoting, to be positioned within mortar of the masonry veneer, whereby the tie strap supports the veneer, with the fastener providing compression and tension support to the masonry veneer, including to inhibit damaging the building insulation. The washer may also include projections or spotting members that initially secure the washer to the insulation prior to the fastener being driven through washer. Furthermore, the fastener may be a double thread differential pitch fastener having two separate threaded areas with different pitch relative to each other to increase the engagement of the fastener with the washer, strap and wall.

In accordance with one aspect of the present invention, a wall tie assembly for use in building construction includes a washer configured to be disposed between an insulation portion of a wall and a veneer portion of the wall. A tie member having a first end portion is configured to engage the washer and a second end portion configured to engage the veneer portion of the wall. A fastener is configured to be driven through the first end portion of the tie member, through an aperture of the washer, and through the insulation portion to engage a structural portion of the wall, where the fastener secures the veneer portion of the wall to the structural portion of the wall via the tie member without substantially compressing the insulation portion therebetween.

In accordance with another aspect of the present invention, a method of securing masonry veneer to a building includes positioning a washer at a location on an insulation portion of a wall. An opening in a tie member is aligned over an aperture of the washer. A fastener is driven through the opening of the tie member, aperture of the washer, and the insulation portion of the wall, and into engagement with a structural portion of the wall for the fastener and tie member to secure the veneer portion of the wall to the structural portion of the wall without substantially compressing the insulation portion therebetween.

These and other objects, advantages, purposes and features of this invention will become apparent upon review of the following specification in conjunction with the drawings.

DESCRIPTION OF THE PREFERRED EMBODIMENTS

Figure 1:
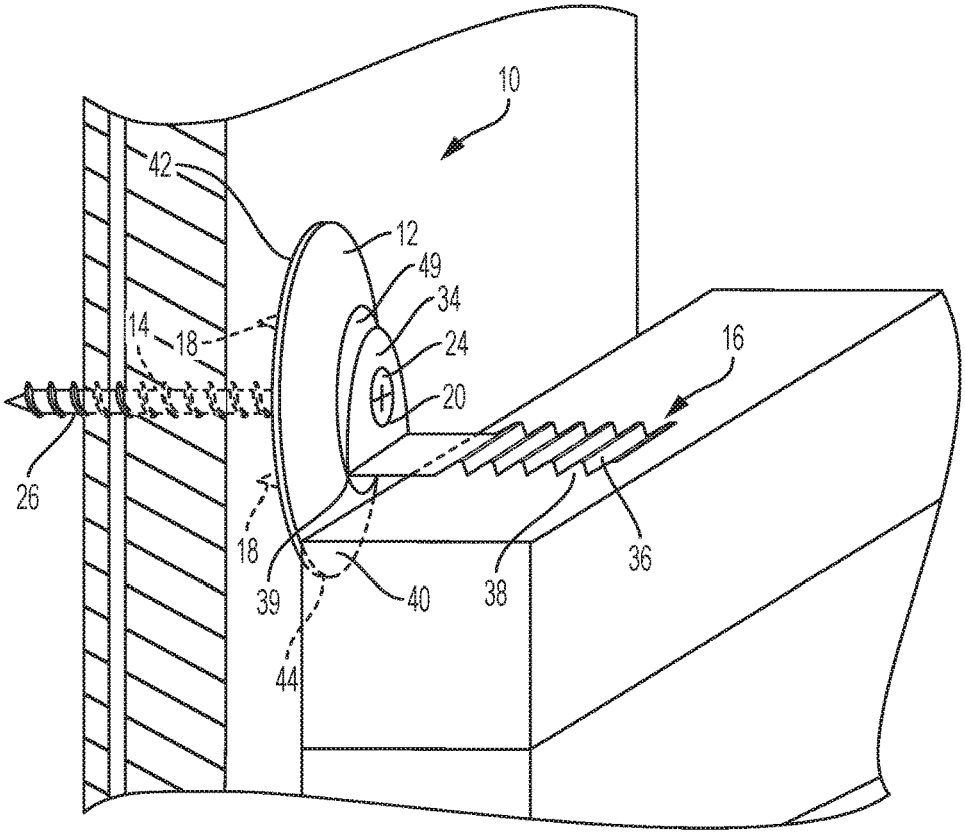
FIG. 1 is a perspective view of a wall tie assembly installed on a partial section of a building wall showing a tie strap in a bent configuration in accordance with an aspect of the present invention.
Figure 2:
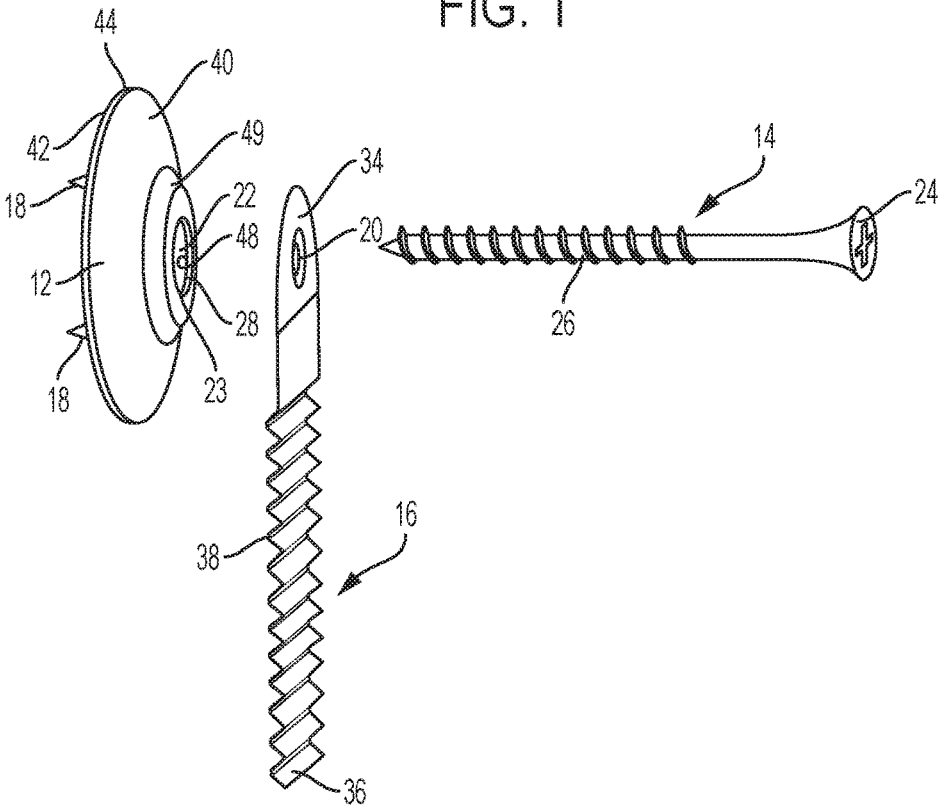
FIG. 2 is an exploded view of the wall tie assembly of FIG. 1 showing the tie strap in a flat configuration.
Figure 3:
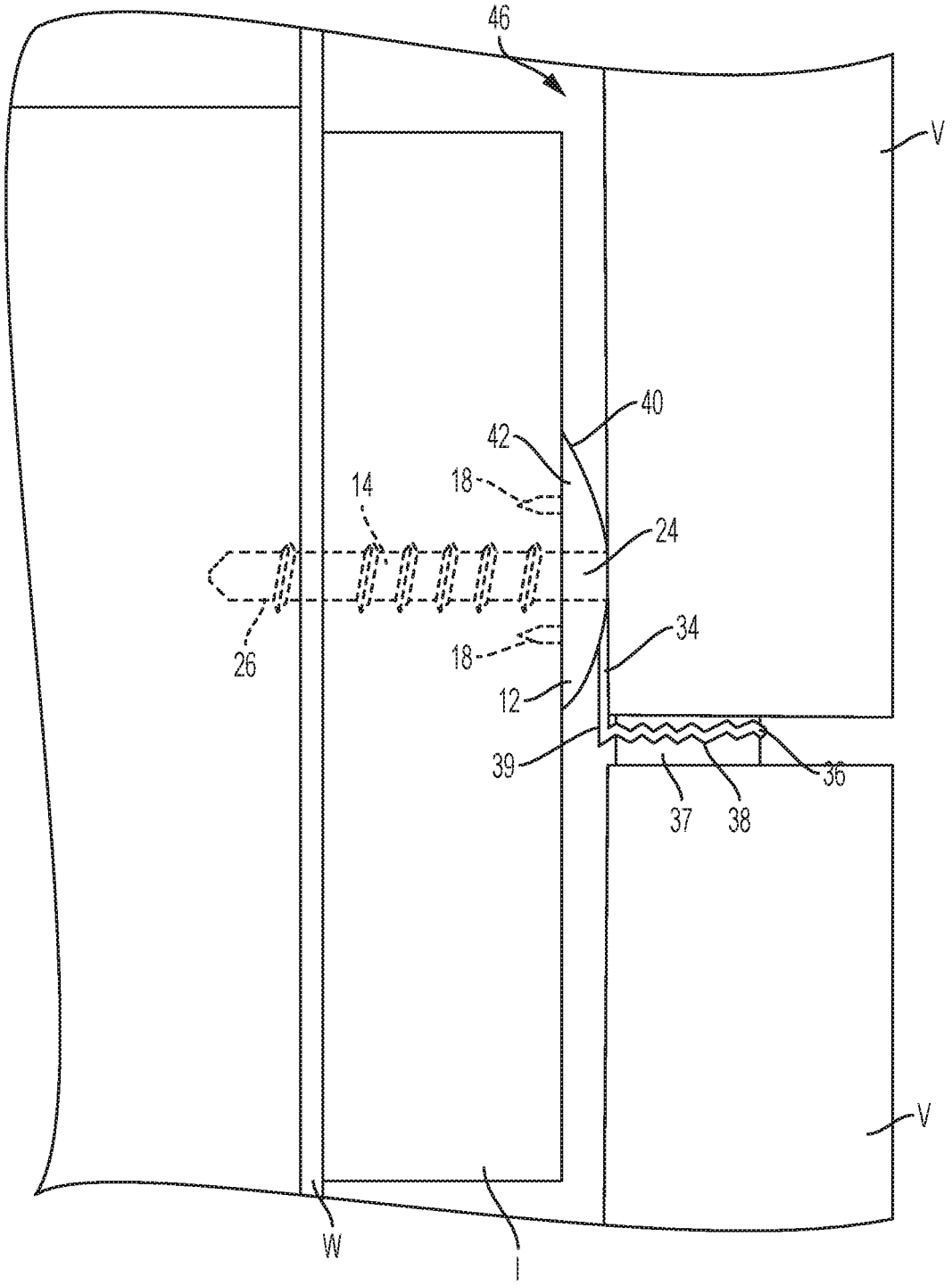
FIG. 3 is a side cross sectional view of the wall tie assembly of FIG. 1 showing on a an inner wall member, insulation, and a masonry veneer of the building wall.

The present invention will now be described with reference to the accompanying figures, wherein the numbered elements in the following written description correspond to like-numbered elements in the figures. According to an aspect of the present invention, a wall tie assembly 10 for use in building construction is shown in FIGS. 1-3 including a washer 12 through which a fastener 14 is disposed, with the fastener 14 coupling a tie member, such as a tie strap 16, of the assembly 10 with the washer 12. The fastener 14 may be used to fix the washer 12 to an internal building structure or wall, such as a wooden or metal stud or sheet, through rigid or semi-insulation I, such as foam insulation. The washer 12 may also include retention protrusions 18 or spotting members that initially secure the washer 12 to the insulation I prior to the fastener 14 being driven through the washer 12 and the tie strap 16. The tie member, such as the tie strap 16, may then be positioned, such as by bending, for locating within mortar or cement or the like of a masonry veneer V. A direct connection of the fastener 14 to the structure of the wall, such as the wall board W and/or stud S, provides for compressive support and tension support of the masonry veneer V relative to the wall, with the washer 12 providing increased surface area contact of the connection to the insulation I. Thus, the tie strap quickly may attach to the wall and extend therefrom to engage and support the masonry veneer, such as brick or stone, at or spaced away from an insulated building wall.

Figure 5:
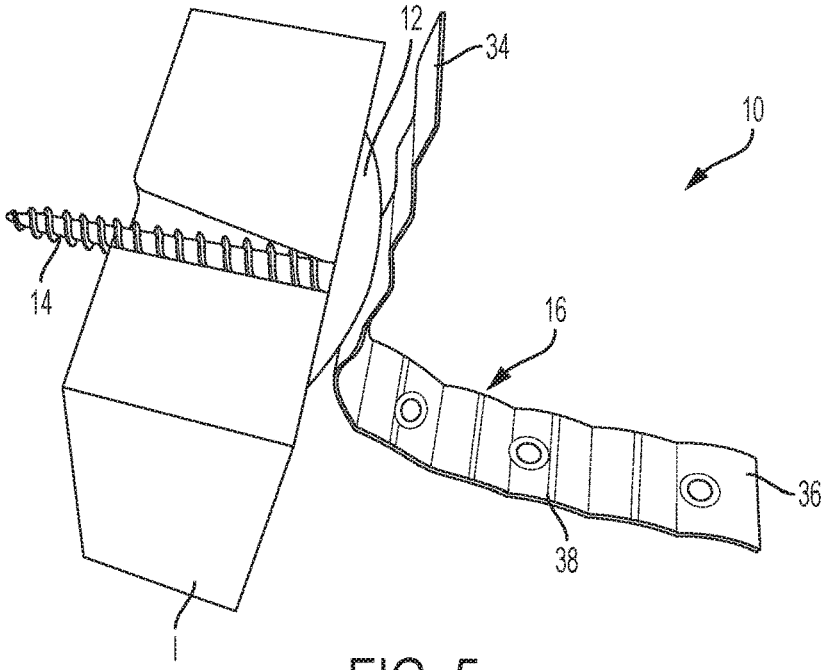
FIG. 5 is a perspective view of the wall tie assembly of FIG. 1 showing a faster extending through building insulation.
Figure 6:
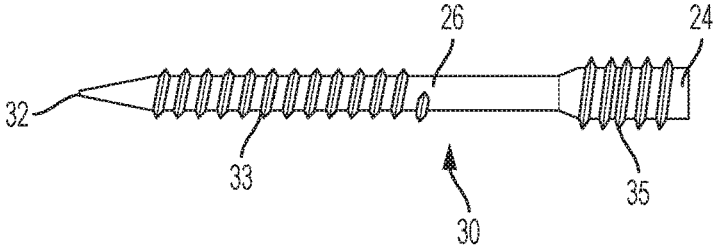
FIG. 6 is a side view of a double thread differential pitch screw fastener for use with a wall tie assembly in accordance with another aspect of the present invention.

During building construction, the insulation I, which may be a rigid or semi-rigid building insulation, is attached to a stud S or a wall board W, such as plywood or oriented strand board ("OSB") of the building wall. The washer 12 is positioned onto the insulation I with a wall tie strap 16 and is fastened to the insulation I by the fastener 14 (FIGS. 3 and 6). The illustrated fastener 14 couples the wall tie strap 16 and the washer 12 to the wall by penetrating a wall tie strap aperture 20, a washer aperture 22, the insulation I, and the stud S and/or the wall board W of the wall to secure the wall tie assembly 10 and the insulation I to the wall. The wall tie strap 16 is further placed in a bent configuration to form a generally L-like shape (FIGS. 1, 3, and 5), such as with an approximate 90 degree bend, whereby the extending portion of the tie strap 16 may be positioned within the mortar or cement between bricks or rocks or the like of the veneer V. The wall tie assembly 10 may be attached to the wall at the building site, or packed and shipped to the building construction site when already pre-attached to the wall or a portion thereof, such as with a prefabricated wall. In the case of a prefabricated wall or portion thereof, the tie strap 16 can remain in an unbent orientation (FIG. 2) with the extending portion of the tie strap 16 laying on the outer surface of the insulation panel I for stacking multiple prefabricated walls or portions thereof on top of each other and shipping the stacked prefabricated walls together.

The fastener 14 is configured to penetrate the insulation I to fix the washer 12 and the tie strap 16 to the building wall. In the embodiment of FIGS. 1 and 2, the fastener 14 comprises a screw having a head 24 and a shaft 26 extending from the head 24. The shaft 26 fits through the washer aperture 22 and wall tie strap aperture 20, with the illustrated shaft 26 having a single pitched thread disposed there about. As shown in FIGS. 1, 3, and 5, the head 24 of the fastener 14 sets within the washer 12, with the head 24 being generally flush with an upper inner perimeter portion 28 (FIG. 2) of the washer 12, such as when the washer 12 would be affixed to a wall.

In another embodiment, the fastener 14 may be a double thread differential pitch screw 30 (FIG. 6) to further facilitate the engagement of the wall tie assembly 10 with the structure of the wall and secure the washer 12 with the screw 30. An exemplary embodiment of such a double thread differential pitch screw 30 is disclosed in U.S. Pat. No. 4,959,938, which is hereby incorporated herein by reference in its entirety. It is also conceivable that the fastener may include other forms of mechanical fasteners and the like.

The double thread differential pitch fastener 30 has a penetrating end 32 opposite the head 24, in which the pitch of the penetrating threads 33 adjacent the penetrating end 32 is different than the pitch of the head threads 35 adjacent the head end 24 of the threaded fastener 30, where the two threads 33, 35 may also have differing diameters. In the illustrated embodiment, the penetrating threads 33 have both a smaller diameter and a smaller pitch than the head threads 35. Thus, when the double thread screw 30 fastens the wall tie assembly 10 to the wall, the screw threads near the head 24, such as the head threads 35, increase the engagement with washer 12 and at the washer aperture 22 and with strap 16 at its through hole with the threads 35 engaging with the washer 12 and strap 16. That is, upon the penetrating threads 33 engaging with the wall, the head threads 35 are separately driven into the washer 12 to fixedly secure the washer 12 and strap 16 with the threaded fastener 30. This engagement between the washer 12 and double thread differential pitch screw 30 generates a clamping or compression force that increases the ability of the wall tie assembly 10 to transfer compression loads from the masonry veneer V to the internal structure of the wall, such as the wall board W and/or the stud S, to thereby further inhibit compression of the insulation I. The double thread differential pitch screw 30 may thereby increase the compression load capacity of the wall tie assembly 10. Moreover, the clamping force generated by the screw 30 between the wall board W and/or stud S and the strap 16 and washer 12 imparts a locking effect that inhibits the screw 30 from backing out.

Although the fastener 30 shown in FIG. 6 has penetrating threads 33 that include both a smaller diameter and a smaller pitch than the head threads 35, it should be appreciated that alternative arrangements of thread geometry may be employed in additional embodiments of the fastener to promote the engagement of the threaded fastener with the washer. Still further, rather than a threaded fastener, an alternative fastener may be employed, such as a nail or scrail or the like.

In the embodiment illustrated in FIGS. 1-3 and 5, the wall tie member is provided as a tie strap 16 that comprises an elongated, corrugated metallic strap in which the wall tie strap aperture 20 is in a first end 34 of the wall tie strap 16. Although illustrated corrugated along its length, a portion of the wall tie strap 16 may include a generally corrugated portion 38 or configuration, such as preferably at a second end 36 that is opposite the first end 34. The corrugation portion 38 may increases the amount of surface area and engagement of the wall tie strap 16 with the mortar 37 of the masonry veneer V. Specifically, the second end 36 of the tie strap 16 terminates within the width of the masonry veneer V, such as preferably approximately between a half and three quarters of the way through the width of the veneer V (i.e. if the brick is 4 inches wide the corrugated strap would be embedded approximately 2 to 3 inches into the width of the brick).

Upon mounting, the wall tie strap 16 may be manually placed in a generally bent configuration to have an L-like shape, as discussed above, between the wall tie strap aperture 20 and the corrugated portion 38. The bending point 39 of the tie strap 16 to form the bent configuration is located at an intermediate location along the length of the tie strap, preferably no more than a half of an inch away from the center of the fastener head or the center of the wall tie strap aperture 20. Thus, the bending point 39 may be provided as an indention that is stamped into the tie strap at the preferred location during the manufacturing process of the tie strap. This indentation may encourage that as the applicator or installer bends the tie strap at the indented location.

Further, as noted, the wall tie strap 16 may be fixed to the wall or a portion thereof in a flat configuration (FIG. 2) and later bent into the L-like shape to increase the ease of attachment and packing density, such as when the wall tie assembly 10 is pre-assembled with the wall or a portion thereof at a manufacturing facility. As discussed below, the wall tie assembly 10 may be attached to the wall or a portion thereof using an electric tool, such as a screw gun, when tie strap 16 is in the flat configuration.

As understood from FIG. 2, the tie strap 16 may include a stamped hole 20 that forms an outwardly extending flange 21, such as a circular flange, where the flange 21 may be used in aligning a hole 20 with an aperture 22 of the washer 12. That is, the flange 21 may be sized to align and be received within a tapered opening 23 surrounding the aperture 22 of the washer 12 to thereby aid in mounting the assembly 10. It should be appreciated that various straps or tie straps may be employed within the scope of the present invention, including existing straps, existing corrugated straps, or particular masonry corrugated straps designed for the present construction.

Referring to FIGS. 1-5, the illustrated washer 12 includes an outerside 40, an underside 42 disposed opposite the outerside 40, and the washer aperture 22 disposed and extending between the outerside 40 and the underside 42, where the washer 12 may be provided to form a seal when secured against the insulation I. In the illustrated embodiment, the washer 12 comprises a washer as disclosed in U.S. Pat. No. 9,309,915, which is incorporated herein by reference in its entirety, such as washer 322 disclosed in U.S. Pat. No. 9,309,915. Alternatively configured washers may, however, be utilized with the wall tie assembly disclosed herein.

The washer 12 may be manufactured from a material with thermally insulating properties, such as plastic or composite polymer-based materials or the like, with the washer aperture 22 configured to receive the fastener 14, as described above, to dispose and secure the underside 42 against a surface, such as against the insulation I (FIGS. 3 and 5). The head 24 and/or shaft 26 of the fastener 14 may also be disposed and sealed against the washer 12, along with the underside 42 of the washer 12 sealing against the insulation I, to inhibit moisture from passing by the washer 12 to reach the structure of the wall, which may be a point of entry through a weather or moisture barrier sheet or wrap applied over the exterior surface of the wall board W or other location on the internal wall. Thus, the washer may interface with the exterior surface of the insulation in a manner to form an uninterrupted circumferential seal that prevents moister and air from penetrating through the aperture formed in the weather barrier of the internal wall by the fastener, so that the fastener penetration is self-sealed.

Optionally, the underside 42 of the washer 12 may include reinforcing members, such as ribs or stiffening features that may increase the structural rigidity of the washer 12, and concentric rings that may function as circumferential sealing surfaces for engagement with the insulation I. As noted, the washer 12 may additionally include projections 18 in the form of pins or legs that are insertable into the insulation I to retain the washer 12 therein until secured with a threaded fastener 14.

As shown, for example in FIGS. 1 and 3, the washer 12 may be disposed in an insulating gap 46 between the insulation I and the veneer V when the veneer V is mounted or affixed to the wall tie assembly 10 (FIG. 3). The insulating gap is preferably occupied by ambient air or the like that generally prevents the insulation from interfacing with the veneer. However, in some embodiments, such as with generally thin washers, the insulating gap may be inconsequential or otherwise only present at or near the washer locations. The illustrated outerside 40 of the washer 12 may have a substantially concave center 48 within a convex shape forming a hump 49 that receives the fastener head 24 (FIG. 2). The thickness and/or shape of the washer 12 may be used in creating or controlling the insulation gap 46.

Figure 4:
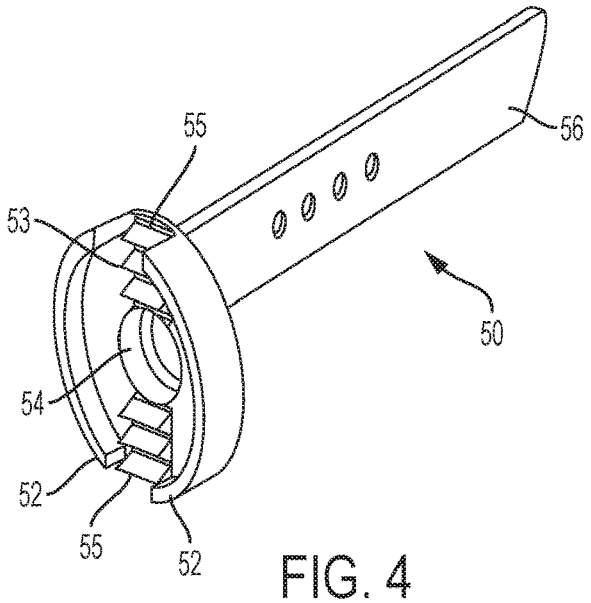
FIG. 4 is a perspective view of an adaptor configured for mounting a wall tie assembly to a building in accordance with another aspect of the present invention.

Referring now to FIG. 4, the wall tie assembly 10 may be mounted via an adaptor 50 that facilitates attaching the fastener 14 and the wall tie strap 16 with the washer 12 and to the building wall and the insulation I. The adaptor may be configured to magnetically and geometrically hold the tie strap 16 between a pair of cutouts 52 that form gaps 55 that are generally sized to be slightly greater than the width of the tie strap 16. In the illustrated embodiment, the cutouts 52 are curvilinear to mate with the rounded washer 12. The illustrated adaptor 50 also has a fastening aperture 54 that is substantially centrally located between the cutouts 52. The fastening aperture 54 may be configured to align with the wall tie strap aperture 20 and the washer aperture 22 during assembly, such as to allow the fastener 14 to pass through the adaptor 50 when the adaptor 50 is holding the strap 16 in a position against the building wall. The cutouts 52 may prevent the wall tie strap 16 from rotating when the fastener 14 is being attached to the building wall. Still further, the internal surface of the adaptor 50 may be provided to have a corrugated surface 53 for mating with the corrugated portion 38 of the tie strap 16, where the corrugated surface 53 of the adaptor 50 includes or is formed from a magnetic material for engaging with tie strap 16. The adaptor 50 may also include an elongated member 56 to affix the adaptor 50 to a fastener gun. Thus, the adaptor 50 is configured to hold the wall tie assembly 10 in a position while the fastener 14 is driven, manually or with an electric gun, into the building wall.

Figure 7:
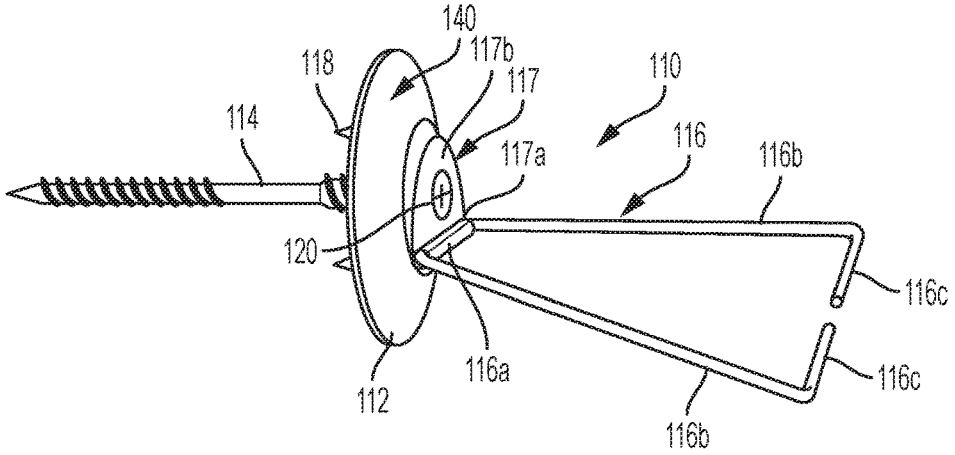
FIG. 7 is a perspective view of a wall tie assembly having a wire tie and swivel flange in accordance with another embodiment of the present invention.
Figure 8:
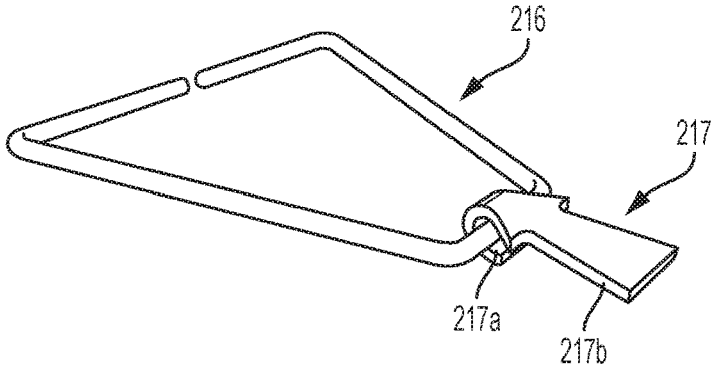
FIG. 8 is a perspective view an additional embodiment of a wire tie and swivel flange in accordance with the present invention.
Figure 9:
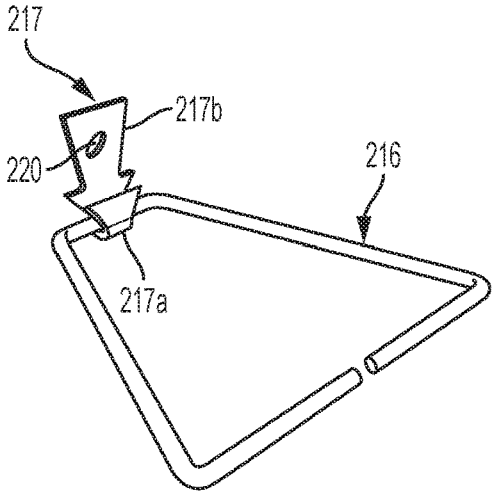
FIG. 9 is a perspective view of the wire tie and swivel flange of FIG. 8 with the wire tie in a perpendicular configuration.
Figure 10:
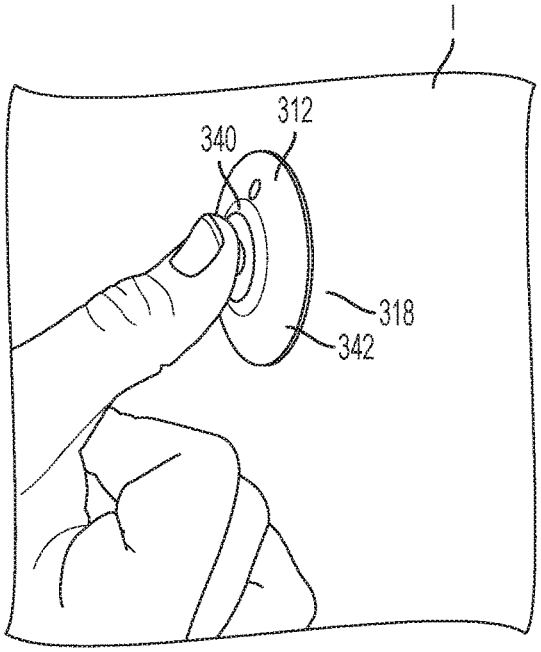
FIGS. 10-13 are perspective views of a washer of a wall tie assembly being manually installed on an insulation panel.
Figure 11:
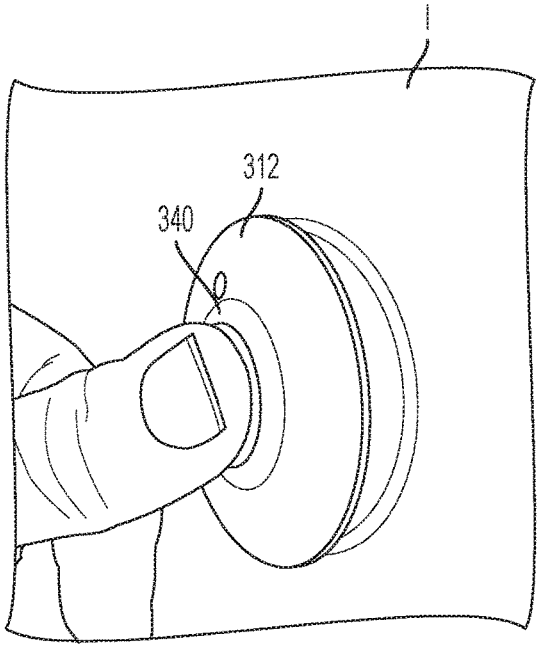
Figure 12:
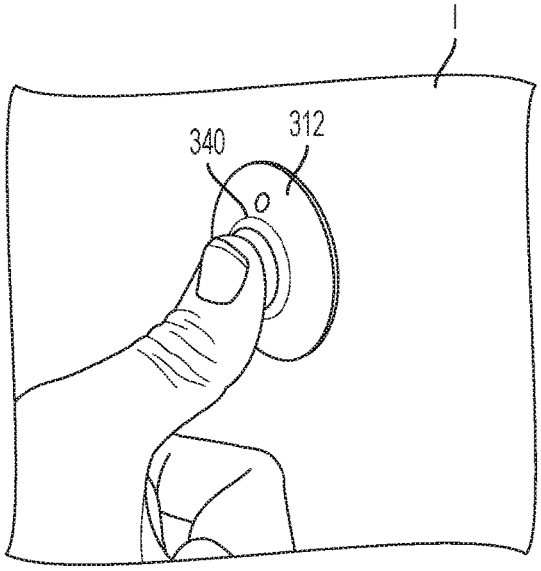
Figure 13:
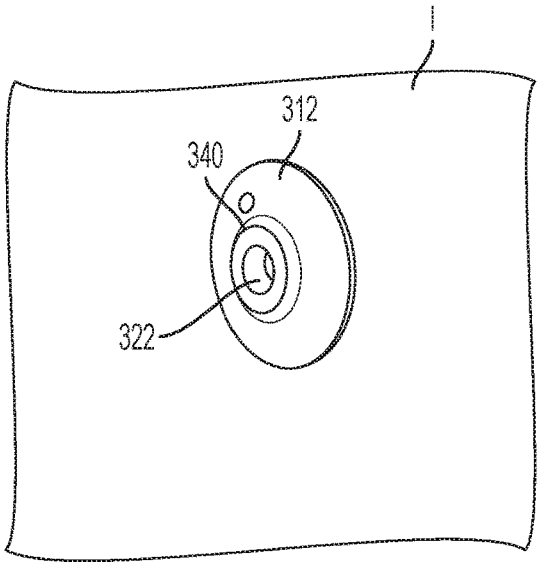
Figure 14:
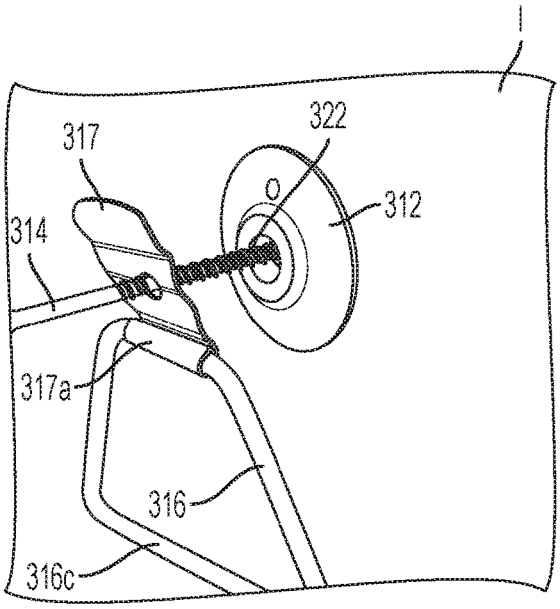
FIGS. 14-17 are perspective views of an embodiment of a wall tie assembly having a bugle head screw attaching a wire tie and swivel flange to the washer of FIG. 13.
Figure 15:
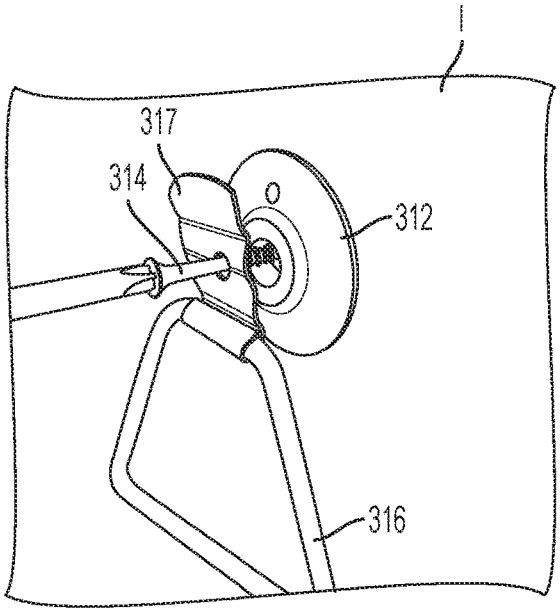
Figure 16:
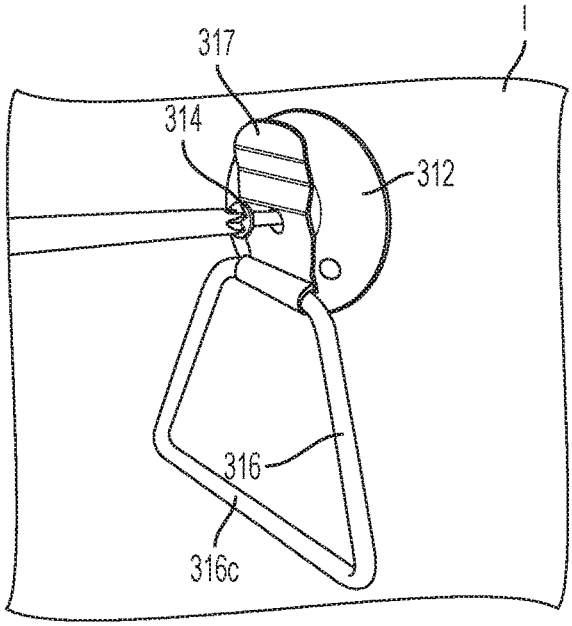
Figure 17:
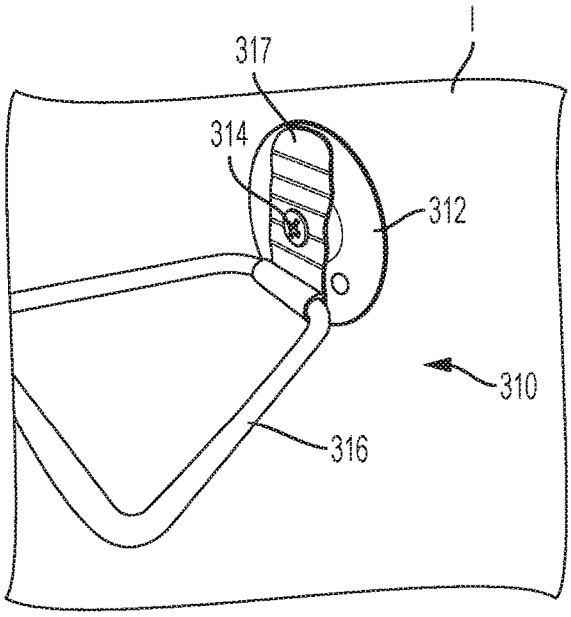

Referring now to FIG. 7, an additional embodiment of a wall tie assembly 110 is provided that includes a tie member comprising a wire tie 116 that is pivotally supported by a swivel flange 117. The swivel flange 117 is engaged to an outerside 140 of a washer 112 by a fastener 114, in place of the tie strap 16 of the embodiment described above. The wire tie 116 may include a single piece of metal wire or bar stock or the like that is formed, such as via bending, to have a triangular or trapezoidal shape, or alternatively another geometric configuration that is capable of engaging within mortar of masonry veneer or the like. The shape of the wire tie 116 may be an open shape defined by unattached ends of the piece of metal wire or bar stock extending away from the washer, such as shown in FIGS. 7-9. Alternatively, shape of the wire tie 316 may be a closed shape defined by an continuous piece of wire or bar stock forming a loop extending from the washer, such as shown in FIGS. 14-20.

As illustrated in FIG. 7, the wire tie 116 includes a pivot section 116*a* that pivotally engages a hinge portion 117*a* of the swivel flange 117. The pivotal engagement between the wire tie 116 and the swivel flange 117 may allow the wire tie 116, when attached to a wall, to be positioned or raised relative to the fastener 114 to an outward protruding or perpendicular configuration relative to the wall, such as shown in FIG. 7. In such a perpendicular configuration, the wire tie 116 may be positioned within mortar of the masonry veneer, whereby the wire tie may be capable of supporting the veneer of residential and commercial walls. As noted, the wire tie 116 may be embedded within mortar when installed or thereafter in cases of prefabricated walls or portions thereof. The overall shape and geometry of the wire tie 116 may be configured to provide a greater amount of engagement with a wider section of the mortar bed when installed, for example compared to the corrugated strap version discussed above, with the mortar disposed within the area or volume bounded by the wire tie 16. As such, the wire tie 116 may provides a higher amount of pull-out resistance against removal, separation or movement of the veneer wall relative to the wall to which wall tie assembly 110 is mounted.

As further shown in FIGS. 7-9, the wire tie 116 is formed to include leg sections 116*b* that extend from the swivel flange and angle away from each other. Also, a distal section 116*c* of the wire tie 116 may be provided away from and in generally parallel alignment with the pivot section 116*a*, such that together with the leg sections 116*b* and the pivot section 116*a*, the wire tie forms a generally trapezoidal shape. The distal section 116*c* of the wire tie 116 is shown in FIGS. 7-9 to be formed by end portions of the wire that are bent toward and into axial alignment with each other. Alternatively, such as shown in FIGS. 14-20, the distal section 316*c* of the wall tie assembly 310 may be a single integral piece of metal wire or bar stock, such that the seam or space between the ends of the metal wire or bar stock may be connected and/or contained in the hinge portion 317*a* of the swivel flange 317. The wire tie may be formed from various metal materials, and in additional embodiments, may be alternatively formed from additional materials, such as plastics, composites, or combinations thereof.

The swivel flange 117 as illustrated in FIG. 7 includes a flange portion 117*b* that engages against the washer 112 and provides an aperture 120 to align with the washer aperture, so that the fastener 114 engages both the washer 112 and the swivel flange 117. The hinge portion 117*a* of the swivel flange 117 may be formed by bending or rolling an edge of a metal plate or sheet to form a curved edge that generally surrounds the pivot section 116*a* of the wire tie 116. A similar embodiment of the swivel flange 217 is shown in FIGS. 8 and 9, which includes an arrow shaped flange portion 217*b* that has an aperture 220 for similarly receiving a fastener and a hinge portion 217*a* that provides less material or metal sheet at a lower cured edge of the swivel flange 117. Further, a metal sheet portion, such as with or without corrugations, may be used to form the swivel flange 317, such as provided in the embodiments shown in FIGS. 14-20. It is contemplated that additional shapes, material types, or configurations of a swivel flange and portions thereof may be provided in alternative embodiments of the wall tie assembly.

To install a wall tie assembly that uses a wire tie, a washer 312 may optionally be mounted to an insulation board I, such as shown in FIGS. 10-13. The washer 312 may also include retention protrusions 318 or spotting members that initially pierce into the insulation board I secure the washer 312 to the insulation I prior to a fastener being driven through washer 312 and tie member. The washer 312 is positioned onto the insulation board in the desired location and a user may press, such as with a finger, on the outerside 340 of the washer 312 to engage the retention protrusions 318, such as those also shown at 118 in FIG. 7, into the insulation board I and place the underside 342 (FIG. 10) against the insulation board I. The engagement of the retention protrusions in the insulation board may allow the washer to be temporarily retained in place against the insulation board I, such that the user can release or disengage contact with the outerside 340 of the washer 312 to select the desired fastener and tie member to then engage the washer 312 and affix to the building wall.

In one example, as shown in FIGS. 14-17, the fastener 314, shown as a standard bugle head screw, couples the tie wire 316 and washer 312 to the structure of the wall by penetrating the aperture 320 of the swivel flange 317, the washer aperture 322, the insulation I, and the stud S and/or the wall board W of the wall to secure the wall tie assembly 310 and the insulation I to the wall. The tie wire 316 is further placed in a raised or perpendicular configuration to form a generally L-like shape (FIG. 16), such as with the tie wire 316 being positioned approximately 90 degrees relative to the swivel flange 317, whereby the leg sections 316*b* and distal section 316*c* of the tie wire 316 may be positioned within the mortar or cement between bricks or rocks of the veneer V. The wall tie assembly 310 may be attached to the wall at the building site, or packed and shipped to the building construction site when already pre-attached to the wall or portions thereof, such as with a prefabricated wall. In the case of a prefabricated wall, the tie wire 316 can remain in a flat or parallel orientation relative to the swivel flange 317 and wall for stacking multiple prefabricated walls on top of each other and shipping the stacked prefabricated walls together.

Figure 18:
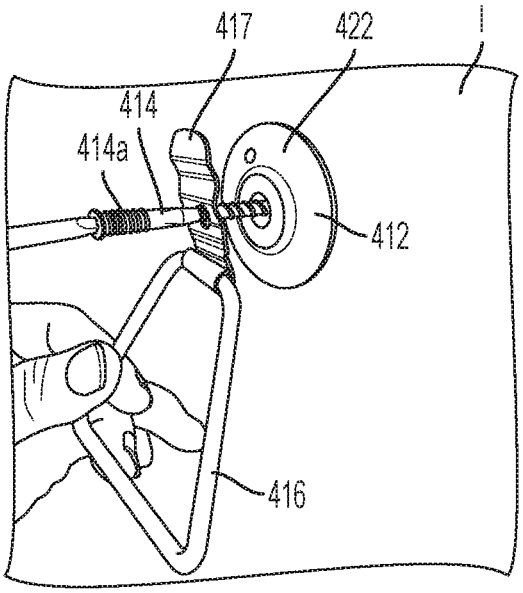
FIGS. 18-20 are perspective views of an embodiment of a wall tie assembly having a double-threaded screw attaching a wire tie and swivel flange to the washer of FIG. 13.
Figure 19:
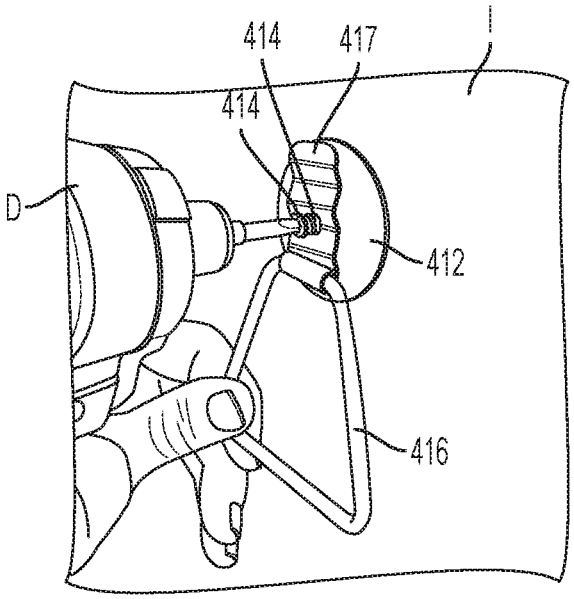
Figure 20:
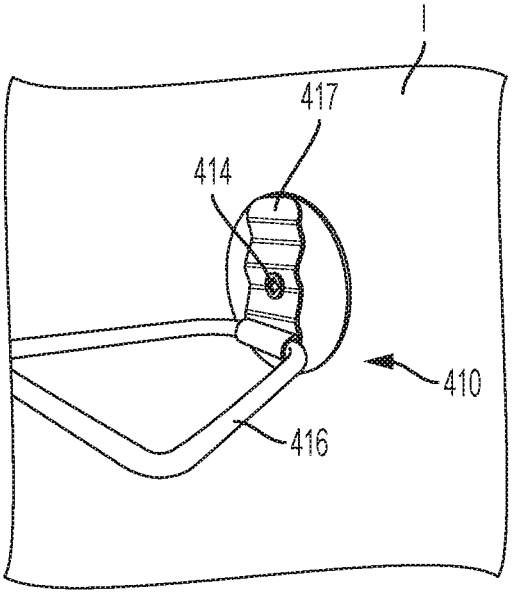

In another example, as shown in FIGS. 18-20, the fastener 414 may be provided as a double threaded differential pitch screw that couples the tie wire 416 and washer 412 to the structure of the wall by penetrating the aperture 420 of the swivel flange 417, the washer aperture 422, the insulation I, and the stud S and/or the wall board W of the wall to secure the wall tie assembly 410 and the insulation I to the wall. Upon securing the double-threaded screw 414, as shown in FIG. 20, the tie wire 416 is further placed in a raised or perpendicular configuration to form a generally L-like shape (FIG. 20), such as with the tie wire 416 being positioned approximately 90 degrees relative to the swivel flange 417, as described above.

The double-threaded screw 414 may be engaged into the wall using an electric tool, such as shown being attached with a hand-held drill D. The double-threaded screw 414 has double thread located on or near the head portion 414*a* of the screw, which is configured to thread into and engage with the swivel flange 417 and plastic washer 412, thereby locking the swivel flange in a generally vertical plane to resist movement under both compression and tension loads. The double-threaded screw 414 has a penetrating end portion 414*b* opposite the head portion 414*a*, in which the pitch and/or thread diameter of the threads adjacent the penetrating end portion 414*b* is different than the pitch and/or thread diameter of the threads adjacent the head portion 414*a* of the double-threaded screw 414. In the illustrated embodiment shown in FIG. 18, threads at the penetrating end portion 414*b* have both a smaller diameter and a smaller pitch than threads at the head portion 414*a*. Thus, when the double thread differential pitch screw 414 fastens the wall tie assembly 10 to the wall, the screw threads near the head portion 414*a* increase the engagement with washer 412 at the washer aperture 422. That is, upon threads at the penetrating end portion 414*b* engaging with structure of the wall, threads at the head portion 414*a* separately are driven into washer 412 to fixedly secure washer 412 with the threaded fastener 414.

This engagement between the washer 412 and double-threaded screw 414 increases the ability of the wall tie assembly 410 to transfer compression loads from masonry veneer V to internal structure of the wall, such as to the wall board W and/or stud S, to thereby further inhibit compression of insulation I. The double-threaded screw 414 thereby increases the compression load capacity of the wall tie assembly 10, as the plastic washer 412 is not be able to slide down the length of the screw and compress and damage the insulation I, unless either the structure of the plastic washer ruptures around the threads or the double-threaded screw 414 is tightened so the swivel flange 417 presses against and compresses the plastic washer into the rigid insulation. The compression resisted by the double-treaded screw, for example, may include when a brick wall is under wind pressure, the brick wall may transfer the wind-applied load inward toward the insulation and the frame of the building, which the double-treaded screw resists by transferring the load along the screw 414 to the wall frame and thereby avoids compression on the insulation I. Also, the pull-out resistance may be greater on the double threaded screw 414 (FIGS. 18-20) when compared to a standard bugle head screw 314 (FIGS. 14-17), but either option for a fastener would function to fix the wall tie assembly to the wall and provide adequate pull-out resistance. Again, it should be appreciated that alternative arrangements of thread geometry may be employed to promote the engagement of the threaded fastener with the washer. Still further, rather than a threaded fastener, an alternative fastener may be employed, such as a nail or scrail or the like.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A method of securing masonry veneer to a building, said method comprising:

positioning a washer at a location on an insulation portion of a wall, wherein said washer is constructed of plastic or composite polymer-based material and includes an underside with at least one projection extending outward from said underside, and wherein said positioning said washer comprises pressing said projection into the insulation portion of the wall such that said underside contacts an outer surface of the insulation portion, and wherein said projection has a length that is less than a thickness of the insulation portion whereby the projection does not extend through the insulation portion;

aligning an opening in a first end portion of a tie member over an aperture of the washer, wherein a second end portion of said tie member is configured to engage a veneer portion of the wall; and driving a fastener through the (1) opening of the tie member, (2) aperture of the washer, and (3) the insulation portion of the wall and into engagement with a structural portion of the wall for the fastener and the tie member to secure the veneer portion of the wall to the structural portion of the wall without substantially compressing the insulation portion therebetween; and wherein the washer includes a seat for engaging with a head of the fastener for sealing thereabout, and wherein the washer includes a sealing surface on the underside of the washer for sealing against the outer surface of the insulation portion.

2. The method of claim 1, wherein said washer includes a thickness that is configured to space the insulation portion away from the veneer portion of the wall.

3. The method of claim 1, wherein said washer includes an additional projection on said underside of said washer with said additional projection having a length that is less than the thickness of the insulation portion, and wherein said positioning said washer comprises pressing both said projections into the insulation portion.

4. The method of claim 1, wherein said tie member comprises a tie strap, wherein said tie strap is reconfigurable between a straight configuration and a bent configuration for engaging the veneer portion of the wall.

5. The method of claim 1, wherein said fastener comprises a double-threaded fastener having a first threaded portion at a penetrating end disposed opposite a head of said fastener and a second threaded portion disposed adjacent said head at a head end of said fastener with the threads of said first threaded portion having a different diameter and/or pitch than the threads of said second threaded portion.

6. The method of claim 5, wherein said outerside of said washer includes a substantially uninterrupted surface for preventing moisture from entering past the outer surface of the insulation.

7. A wall tie assembly for use in building construction, said wall tie assembly comprising:

a washer having an outerside and an underside disposed opposite said outerside and an aperture extending from said outerside through to said underside;

a tie member having a first end portion engaging said outerside of said washer and a second end portion, wherein said tie member comprises an elongated tie strap, and wherein said second end portion extends opposite from said first end portion and comprises a corrugated portion; and a fastener, said fastener having a penetrating end disposed opposite a head of said fastener, said penetrating end configured to be driven through said first end portion of said tie member and through said aperture of said washer with said head of said fastener engaging said first end portion to secure said tie member to said outerside of said washer;

wherein said washer is configured to be disposed between an insulation portion of a wall and a veneer portion of the wall with said underside of said washer in contact with the insulation portion, and wherein said penetrating end of said fastener is configured to be driven through the insulation portion to engage a structural portion of the wall, and wherein said corrugated portion of said second end portion of said tie member is configured to engage the veneer portion of the wall.

8. The wall tie assembly of claim 7, wherein said fastener comprises a double-threaded fastener having a first threaded portion at a penetrating end disposed opposite a head of said fastener and a second threaded portion disposed adjacent said head at a head end of said fastener with the threads of said first threaded portion having a different diameter and/or pitch than the threads of said second threaded portion.

9. The wall tie assembly of claim 7, wherein said tie strap is deformable so as to be reconfigurable between a straight configuration and a bent configuration for engaging the veneer portion of the wall, and wherein said bent configuration bends said tie strap at an intermediate point between said fastener and said second end portion of said tie strap.

10. The wall tie assembly of claim 7, wherein said washer includes at least one projection on said underside that is configured to engage the insulation, and wherein said washer includes a thickness that is configured to separate the insulation portion away from the veneer portion of the wall.

11. The method of claim 1, wherein a barrier sheet or wrap is disposed behind the insulation portion opposite the outer surface of the insulation portion that is contacted by said underside of said washer, and wherein said driving the fastener comprises driving the fastener through the barrier sheet or wrap.

12. A method of securing masonry veneer to a building, said method comprising:

providing a washer constructed of plastic or composite polymer-based material, wherein the washer includes an aperture extending through the washer and includes an underside;

providing a tie strap, wherein the tie strap includes a first end portion and a second end portion and is reconfigurable between a straight configuration and a bent configuration, wherein an opening is included in the first end portion and the second end portion is configured to engage a veneer portion of a wall when the tie strap is in the bent configuration;

aligning the opening of the first end portion of the tie strap with the aperture of the washer;

inserting a fastener through the opening of the tie member and the aperture of the washer and driving the fastener into engagement with a structural portion of the wall whereby the underside of the washer engages upon a surface of the wall; and embedding the second end portion of the tie strap in the masonry veneer portion of the wall;

wherein the washer includes a seat for engaging with a head of the fastener for sealing thereabout, and wherein the washer includes a sealing surface on the underside of the washer for sealing against the surface of the wall.

13. The method of claim 12, wherein said washer includes a thickness that is configured to space the veneer portion of the wall from the surface against which the underside of the washer is sealed.

14. The method of claim 12, wherein the washer includes at least one projection extending outward from the underside, and wherein said method further comprises pressing the projection into an insulation portion of the wall such that the surface that the underside contacts is an outer surface of the insulation portion, and wherein the projection has a length that is less than a thickness of the insulation portion whereby the projection does not extend through the insulation portion.

15. The method of claim 14, wherein the washer includes an additional projection on the underside of the washer with the additional projection having a length that is less than the thickness of the insulation portion, and wherein said pressing the projection into the insulation portion comprises pressing both said projections into the insulation portion.

* * * * *